US005120244A

United States Patent [19]

Saito et al.

[11] Patent Number: 5,120,244

[45] Date of Patent: Jun. 9, 1992

[54] INSULATION-PIERCING CONNECTOR

[75] Inventors: Yukio Saito; Yoshiaki Igarashi, both of Tokyo, Japan

[73] Assignee: Daiichi Denshi Kogyo Kabushiki Kaisha, Tokyo, Japan

[21] Appl. No.: 675,792

[22] Filed: Mar. 27, 1991

[30] Foreign Application Priority Data

Mar. 29, 1990 [JP] Japan ..... 2-78625

[51] Int. Cl.[5] ..... H01R 4/24

[52] U.S. Cl. ..... 439/395

[58] Field of Search ..... 439/389–425

[56] References Cited

U.S. PATENT DOCUMENTS 4,753,608 6/1988 Yamaguichi ..... 439/395
4,767,352 8/1988 Pretchel ..... 439/395
4,770,646 9/1988 Shimada ..... 439/395

FOREIGN PATENT DOCUMENTS 0323340 5/1989 European Pat. Off. .

*Primary Examiner*—Joseph H. McGlynn

*Attorney, Agent, or Firm*—Silverman, Cass & Singer, Ltd.

[57] ABSTRACT

An insulation-piercing connector includes a connector main body made of an insulating support block having inclined bases inclined in the same direction and a reverse direction and contacts embedded therein to expose contact tails. The contact tails are arranged in first, second, third and fourth rows in parallel with and spaced from each other and staggered or shifted from each other. A cover includes inclined bases inclined in reverse directions to those of the mating inclined bases of the connector main body and receiving slots for receiving the contact tails of the connector main body. Inclined surfaces of the inclined bases of the connector main body and the cover are curved surfaces. The first and second rows and the third and fourth rows of the contact tails are arranged in symmetry with respect to tops of the curved surfaces, respectively. The inclined bases of the connector main body and the cover are provided with protrusions for guiding the connection wires.

4 Claims, 5 Drawing Sheets

FIG_4c
PRIOR ART
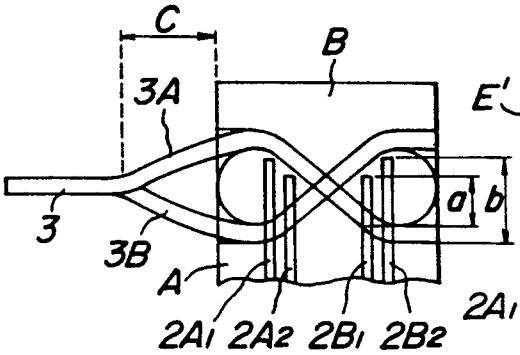
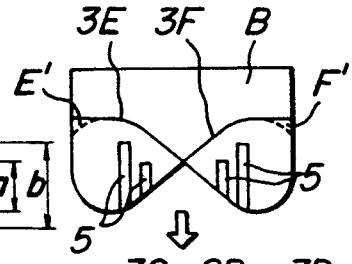
FIG_4b
PRIOR ART
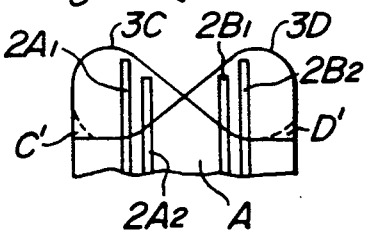
FIG_4a
PRIOR ART
FIG_5c
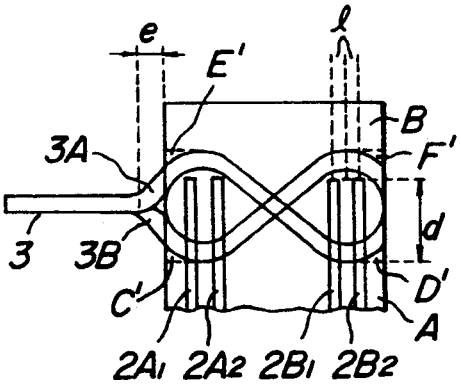
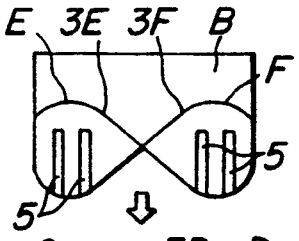
FIG_5a
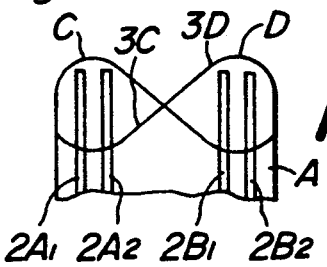
FIG_5b

INSULATION-PIERCING CONNECTOR

BACKGROUND OF THE INVENTION

This invention relates to an electrical connector whose contacts are connected to connection wires in an insulation-piercing system, and more particularly to an arrangement of contacts and configuration of connection wire receiving portions of a connector main body and urging portions of a cover.

There have been many ways for connecting wires and contacts of a connector, such as soldering, wrapping, crimping and insulation-piercing method and the like. In the insulation-piercing method among these ways, a connection wire 3 is forced by means of a cover B into the tail 2 of a contact fixed to an insulating support block 1 of a connector main body A. The tail 2 has a piercing groove 2*a* at its center and oblique blades 2*b* on both sides thereof as shown in FIG. 1*a*. As a result, the coating 3*a* of a connection wire 3 is cut by the oblique blades 2*b* to the core 3*b* of the connection wire 3. Thereafter, the connection wire 3 is forced into the piercing groove 2*a* so that the contact tail 2 is connected to the core 3*b* of the connection wire 3.

With development of electronics, electronic parts have been required to be highly dense and miniaturized year by year. According to these requirements, an insulation-piercing connector has been proposed in Japanese Patent Application No. 63-253,419 as shown in FIG. 2*a* and 2*b*. FIG. 2*a* illustrates a connector main body A in a perspective view, while FIG. 2*b* illustrates in a perspective view a cover B of the connector turned upside down in order to clearly show its characteristic parts.

Referring to FIGS. 2*a* and 3*a*, the connector main body A includes a plurality of insulation-piercing contact tails (referred to hereinafter as "contact tails") 2 arranged in first, second, third and fourth rows $2A_1$, $2A_2$, $2B_1$ and $2B_2$ in parallel and spaced from each other. Moreover, connection wire support inclined bases 3C and 3D for supporting connection wires are arranged on the upper surface of the insulating support block 1 so that the inclined bases 3C and 3D are within the width of the contact tails, and surfaces of the inclined bases 3C and 3D are inclined in reverse directions. Between two inclined bases 3C inclined in the same direction is arranged one inclined base 3D inclined in the reverse direction which is positioned at the center of a contact tail forming the first row $2A_1$.

Moreover, the contact tails forming the second row $2A_2$ are so fixed to the insulating support block 1 that centers of these contact tails are positioned at centers between the contact tails forming the first row $2A_1$, and within the width of each of the contact tails are arranged two inclined bases 3D inclined in the same direction and one inclined base 3C inclined in the reverse direction. Further, the contact tails forming the third and fourth rows 2B1 and 2B2 are fixed to the insulating support block 1 so as to be shifted by one inclined base 3C and extend over two inclined bases 3D so that the contacts of the third and fourth rows are staggered or alternately shifted. Heights and inclinations of the inclined bases are so selected that only piercing grooves of the contact tails 2 to be connected with the connection wires 3 project upwardly beyond the inclined bases, whereas other contact tails 2 do not project beyond the inclined bases.

Referring to FIG. 2*b*, the cover B includes inclined bases 3E and 3F for supporting connection wires, which are adapted to be inserted between the inclined bases 3C and 3D of the connector main body A and inclined in direction reverse to the inclined directions of the inclined bases 3C and 3D. The cover B further includes receiving slots 5 for receiving the contact tails 2 projecting from the connector main body A. Reference numerals 4A and 4B denote hooks and anchoring members for locking the connector main body A and the cover B.

With this arrangement, connection wires, for example, connection wires 3A and 3B of a flat cable 3 (FIG. 3*b*) are arranged on the surfaces of the inclined bases 3C and 3D, and the cover B is arranged over the connector main body A and forced toward the main body A. As a result, the flat cable 3 is connected to the contacts 2 forming the contact tail rows $2A_1$, $2A_2$, $2B_1$ and $2B_2$ as shown in FIGS. 1*b* and 3*a*.

However, the above insulation-piercing connector of the prior art involves the following problems to be solved.

FIGS. 4*a*, 4*b* and 4*c* illustrate a relationship in height between the contact rows $2A_1$, $2A_2$, $2B_1$ and $2B_2$ of the contact tails 2 of the prior art connector shown in FIGS. 2*a* and 2*b*.

(1) As shown in FIG. 4*a* illustrating the assembled contact main body A and cover B, piercing depths are different as indicated by a and b between the contact rows $2A_1$ and $2B_2$ arranged on the outer side and the contact rows $2A_2$ and $2B_1$ on the inner side. Therefore, there is a difference in piercing force by which the core 3*b* of the connection wire is forced into the piercing groove 2*a*. Consequently, when a connector is miniaturized, the contacts on the inner side become short resulting in less reliability in connection.

(2) When the flat cable 3 shown in FIG. 3*b* is arranged on the inclined bases 3C and 3D of the connector main body, and the cover B is then arranged thereon and forced toward the connector main body A. As a result, the connection wires 3A are pushed upwardly and connection wires 3B are pushed downwardly so that the contact tails pierce into the connection wires 3A and 3B. In the prior art, a torn length c of the flat cable 3 shown in FIG. 4*c* is long. Therefore, this connector does not fulfill the requirement of miniaturization.

SUMMARY OF THE INVENTION

It is an object of the invention to provide an improved insulation-piercing connector which eliminates the disadvantages of the prior art and which improves the reliability in connection and fulfills the requirement of miniaturization.

The above object can be accomplished by the following measures according to the invention.

(1) Connection wire connecting portions of inclined bases 3C, 3D, 3E and 3F of a connector main body A and a cover B are curved. The connection wire connecting portions are positioned at locations where cores 3*b* of the connection wires 3 are connected to contact tails.

(2) Rows $2A_1$ and $2A_2$ of the contact tails are arranged at equal distances 1 from tops of the curved portions. Likewise, rows $2B_1$ and $2B_2$ of the contact tails are arranged at equal distances 1 from tops of the curved portions.

(3) Protrusions for guiding the connection wires are provided at out going ends of the inclined bases of the connector main body and the cover.

For example, as shown in FIG. 5*b*, the rows $2A_1$ and $2A_2$ of the contact tails 2 are arranged in symmetry with respect to the tops of the curved portions C of the inclined bases of the connector main body, while the rows $2B_1$ and $2B_2$ are arranged in symmetry with respect to the tops of the curved portions D of the inclined bases of the connector main body.

Moreover, as shown in FIG. 5*a*, the cover B is provided with the curved portions E and F which are compatible with the curved portions C and D of the connector main body A when the cover B is arranged on the connector main body A.

With the above arrangement according to the invention, the following significant effects can be brought about.

(1) Heights of the contact tails 2 forming the rows $2A_1$ and $2A_2$ and the rows $2B_1$ and $2B_2$ can be substantially equal. Moreover, piercing distances of cores of the connection wires 3 can be substantially equal as shown by d in FIG. 5*c*.

(2) As shown in FIG. 5*c*, the protrusions C', D', E' and F' for guiding the connection wires 3 prevent the out going portions of the connection wires from being pushed too far upwardly and downwardly when the cover B is forced toward the connector main body A after the connection wires are arranged between the connector main body A and the cover B. Therefore, torn lengths of the flat cable 3 at its out going portions can be shortened as shown by e in FIG. 5*c* in comparison with those in the prior art.

The invention will be more fully understood by referring to the following detailed specification and claims taken in connection with the appended drawings.

BRIEF DESCRIPTION OF THE DRAWINGS

FIGS. 5*a*, 5*b*and 5*c*; and 6*a* and 6*b* are views for explaining the insulation-piercing connector according to the invention;

DESCRIPTION OF THE PREFERRED EMBODIMENTS

Figure 1A:
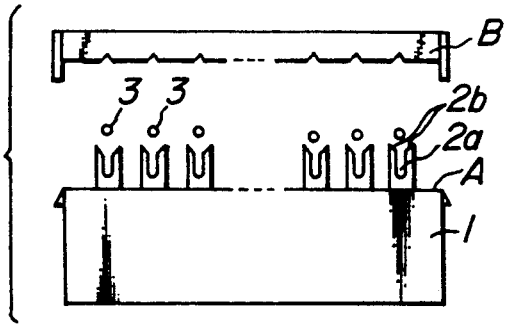
FIG 1a PRIOR ART
FIGS. 1*a* and 1*b* are explanatory views for the insulation-piercing method of connecting wires to contacts of a connector of the prior art.
Figure 1B:
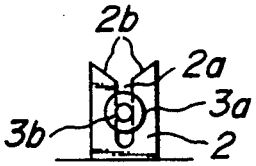
FIG 1b PRIOR ART
Figure 2A:
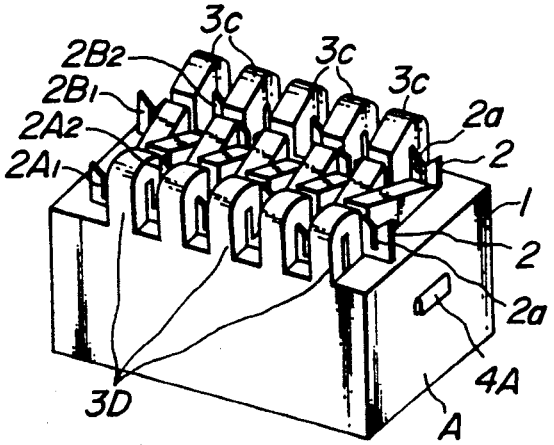
FIG 2a PRIOR ART
FIGS. 2*a* and 2*b*; 3*a* and 3*b*; and 4*a*, 4*b* and 4*c* are views for explaining insulation-piercing connections of the prior art.
Figure 3A:
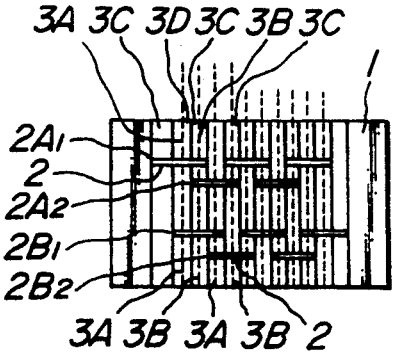
FIG 3a PRIOR ART
Figure 2B:
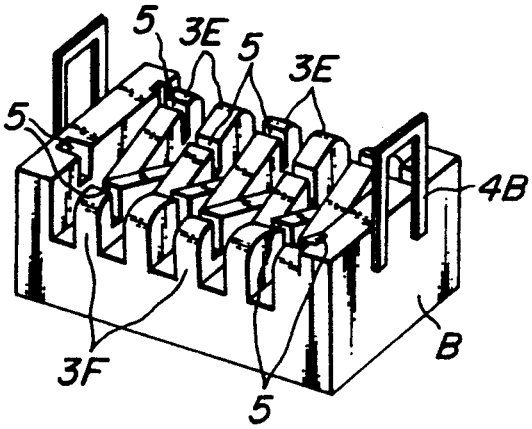
FIG 2b PRIOR ART
Figure 3B:
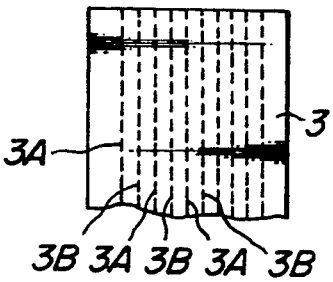
FIG 3b PRIOR ART
Figure 6A:
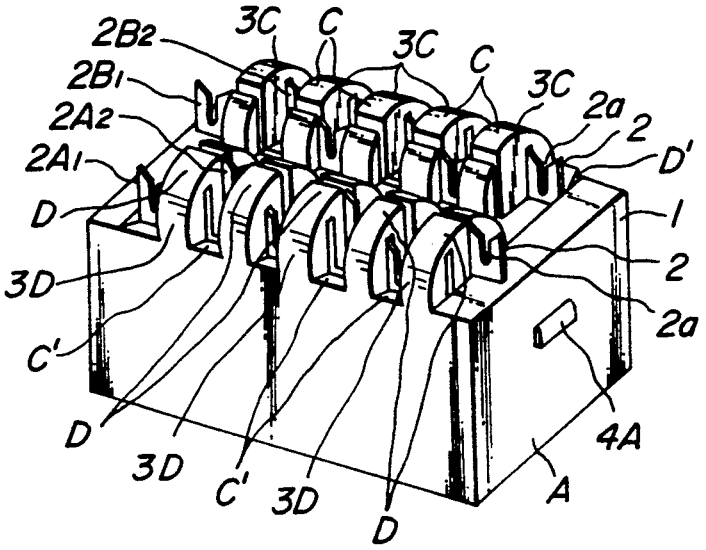
Figure 6B:
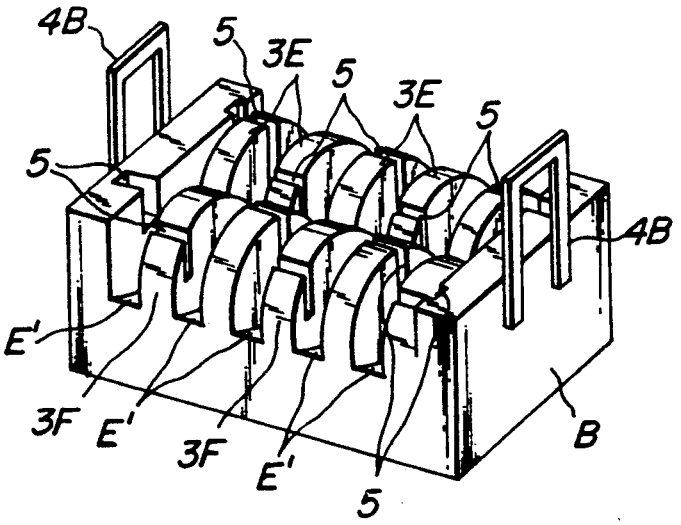
Figure 7:
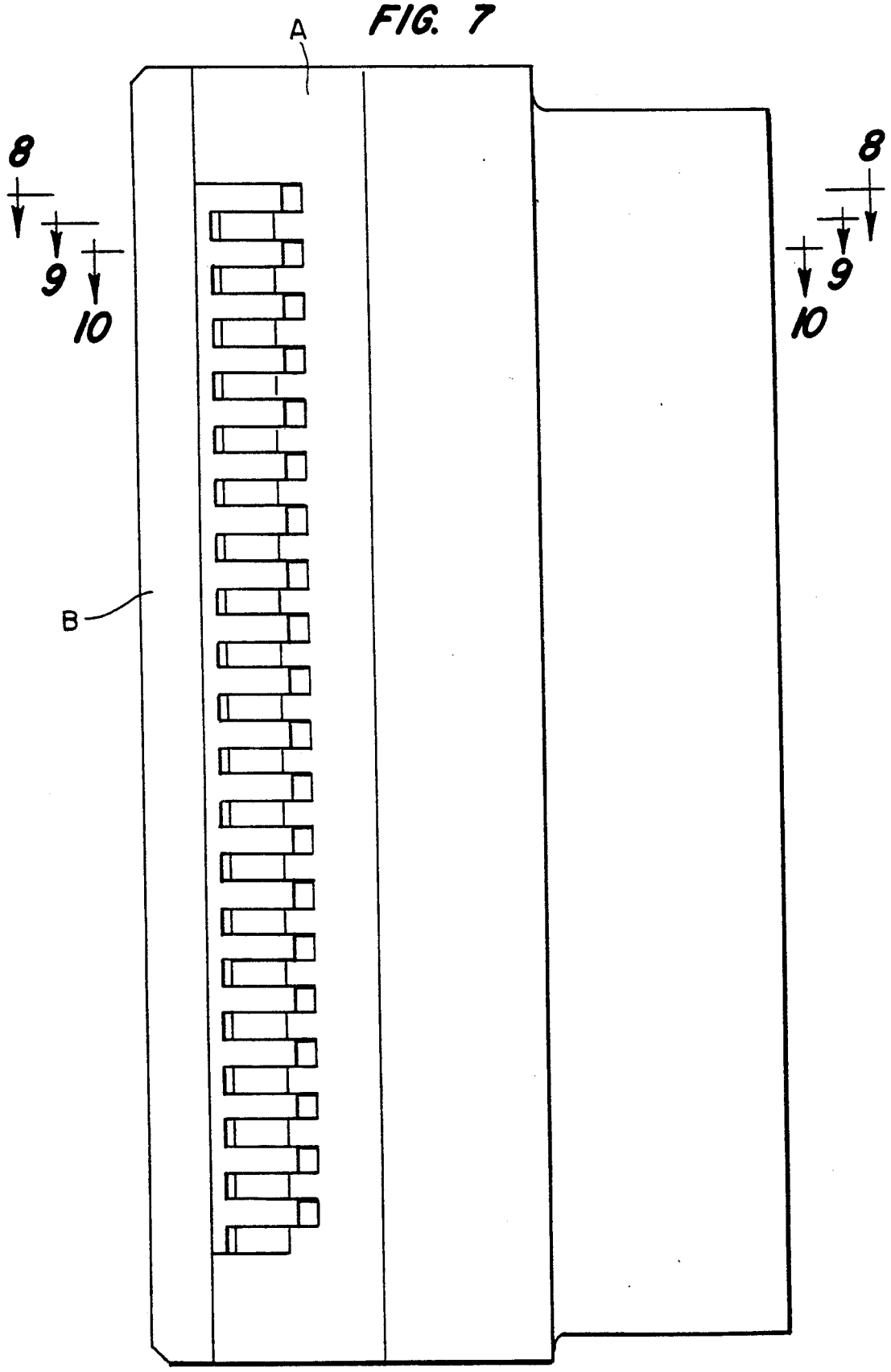
FIG. 7 is a side view of the connector constructed according to the present invention.
Figure 8:
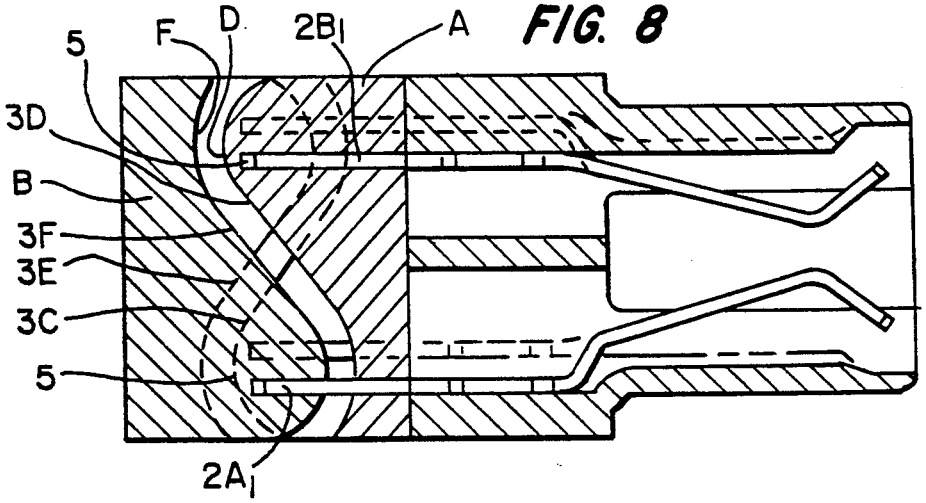
FIG. 8 is a sectional view taken along the line 8-8 of FIG. 7 in the direction indicated generally.
Figure 9:
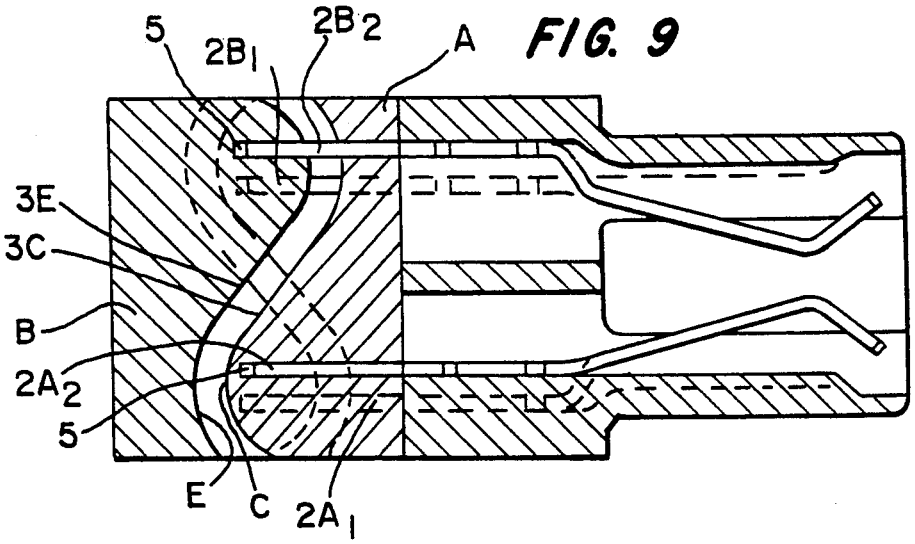
FIG. 9 is a sectional view taken along the line 9-9 of FIG. 7 in the direction indicated generally.
Figure 10:
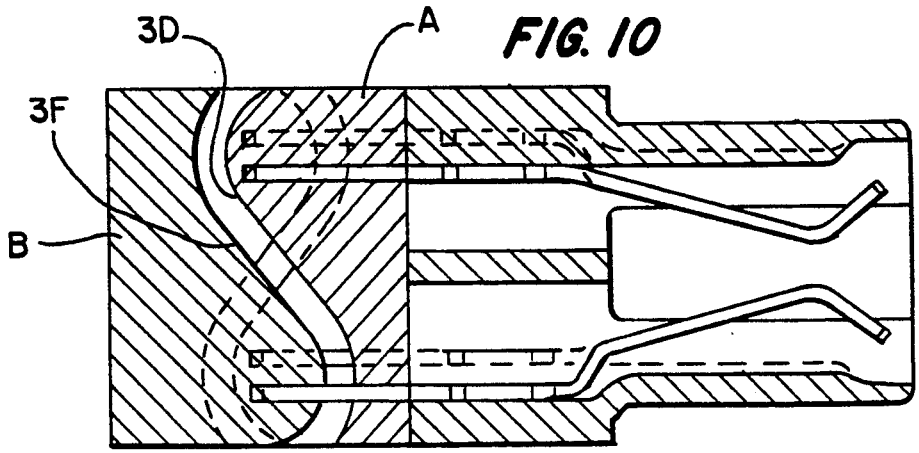
FIG. 10 is a sectional view taken along the line 10-10 of FIG. 7 in the direction indicated generally.

FIGS. 6*a* and 6*b* illustrate in perspective views a connector main body A and a cover B of one embodiment of the invention, respectively. Referring to FIG. 6*a*, the connector main body A includes an insulating support block 1 having hooks 4A for locking with the cover B. The support block 1 includes connection wire support inclined bases 3C and connection wire support inclined bases 3D inclined in reverse directions to the inclined bases 3C. The support block 1 further includes insulation-piercing contact tails 2 having an equal height and an equal width.

As above described, contact tails in rows $2A_1$ and $2A_2$, and $2B_1$ and $2B_2$ are arranged in a manner so that they are staggered or alternately shifted. Moreover, the contact tail rows $2B_1$ and $2B_2$ are shifted relative to the contact tail rows $2A_1$ and $2A_2$ by the width of one inclined base. Furthermore, the contact tails and the inclined bases are arranged in the following manner. Two inclined bases 3C inclined in the same direction and one inclined base 3D inclined in the reverse direction are arranged within the width of each of the contact tails forming the contact rows $2A_1$ and $2A_2$. The one inclined base 3D is at a center between the two inclined bases 3C. Two inclined bases 3D and one inclined base 3C are arranged within the width of each of the contacts tail forming the contact tail rows $2B_1$ and $2B_2$. Moreover, inclinations and heights of the inclined bases are so determined that only piercing grooves 2*a* of the contact tails to be connected with connection wires project beyond the inclined bases upwardly, whereas other contact tails do not project beyond the inclined bases. This construction is substantially the same as those of the prior art.

According to the invention curved portions C and D are provided on the inclined bases 3C and 3D for supporting connection wires on the side of the connector main body A. As can be seen from FIGS. 5*a*-5*c*, the curved portions are provided at locations corresponding to the cable core connected positions. Moreover, the first and second rows $2A_1$ and $2A_2$ are located in symmetry with respect to the tops of the curved portions C, while the third and fourth rows $2B_1$ and $2B_2$ are located in symmetry with respect to the tops of the curved portions D. As shown in FIG. 6, the curved portions of the inclined bases are preferably circular arcuate surfaces.

Connection wire guide protrusions C' and D' for guiding connection wires are provided at out going ends of the inclined bases 3C and 3D at least the inclined bases 3C. These protrusions are preferably formed as extensions of surfaces of the curved portions provided on the inclined bases because a flat cable can be readily deformed without difficulty.

Referring to FIG. 6*b*, the cover B includes anchoring members 4B for locking with the connector main body A, and connection wire support inclined bases 3E and 3F for supporting the connection wires, which are inclined in directions reverse to those of the inclined bases 3C and 3D of the connector main body A. The cover B further includes receiving slots 5 for receiving the contact tails 2, and connection wire guide protrusions E' and F' having curved surfaces for guiding the connection wires (protrusions F' are not shown in the drawing).

A flat cable 3 having a plurality of connection wires arranged in a plane is then arranged on the connector main body A, and the cover B is arranged over the connector main body A and forced toward the connector main body A. When the anchoring members 4B of the cover B are locked by the hooks 4A of the connector main body A, the projecting contact tails penetrate into the receiving slots 5 so that the connection wires 3A and 3B of the flat cable 3 are forced into the piercing apertures 2*a* of the contact tails 2 to be connected with the contacts. At the same time, the connection wires 3A are embraced and securely held to be prevented from removing from connector by means of the inclined bases 3C and 3E and 3D and 3E of the connector main body A and the cover B. Moreover, the connection wire guide protrusions C' and D' and E' and F' serve to guide the connection wires 3A and 3B so that torn lengths of the flat cable are shortened.

Instead of providing on extensions of the curved portions, the connection wire guide protrusions of the connector main body A and the cover B may be provided on flat portions of out going ends as shown in dash lines in FIG. 5. If the out going lines of the connection wires are only one side, the connection wire guide protrusions may be provided only on this side.

As can be seen from the above explanation, the connector concerning the present invention includes contacts arranged in four rows staggered and adapted to be connected with connection wires in insulation-piercing method by the use of inclined bases for supporting the connection wires. By making equal respective heights and respective piercing depths of the contact tails, the connector according to the invention is high in reliability in connection to wires and accomplishes miniaturization of connector owing to shortened torn lengths of a flat cable.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An insulation-piercing connector comprising, a connector main body having an insulating support block, a cover, insulation-piercing contacts in said insulating support block, said contacts having contact tails separated by respective insulation-piercing grooves, said contact tails being arranged in first, second, third and fourth rows parallel with and spaced from each other, said insulating support block including connection wire support inclined bases for supporting connection wires, each of the contact tails forming the first row being arranged so that two inclined bases inclined in the same direction and one inclined base inclined in a reverse direction and positioned at a center between the two inclined bases are arranged within a width of each of the contact tails forming the first row, each of the contact tails forming the second row being arranged so that their insulation-piercing grooves are positioned between the contact tails forming the first row, two inclined bases inclined in the same direction and one inclined base inclined in a reverse direction and located at a center of the contact tail being arranged within a width of each of the contact tails forming the second row, whereby the contact tails forming said first and second rows are staggered with respect to each other, the contact tails forming said third and fourth rows being fixed to the insulating support block and positioned to be shifted with respect to each other by one inclined base, each of said contact tails extending over two inclined bases inclined in the same direction and one inclined base inclined in a reverse direction, whereby the contact tails forming said third and fourth rows are staggered with respect to each other, the heights and inclinations of the inclined bases being selected so that the contact tails to be connected with connection wires project beyond surfaces of the inclined bases and other contact tails do not project beyond the surfaces of the inclined bases, said cover including connection wire support inclined bases inclined in reverse directions to those of the connection wire support inclined bases of the connector main body, receiving slots for receiving the contact tails projecting beyond the inclined bases of the connector main body, said connection wire connecting portions of the inclined bases of the connector main body and the cover being formed in curved surfaces, said first and second rows of the contact tails being arranged in symmetry with respect to centers of the curved surfaces thereof and said third and fourth rows of the contact tails being arranged in symmetry with respect to centers of the curved surfaces thereof, the connection wire support inclined bases of the connector main body and the cover being provided with connection wire guide protrusions for guiding the connection wires.

2. An insulation-piercing connector as defined in claim 1 in which said curved surfaces of the connection wire support bases are circular arcuate surfaces.

3. An insulation-piercing connector as defined in claim 1 in which said contact tails have substantially the same width and are fixed to the insulating block to be the same height.

4. An insulation-piercing connector as defined in claim 1 in which said connection wire guide protrusions are formed by smooth extensions of the curved surfaces of the connection wire support inclined bases.

* * * * *